US005511613A

United States Patent [19]

Mohn et al.

[11] Patent Number: 5,511,613

[45] Date of Patent: Apr. 30, 1996

[54] ELONGATED HEAT EXCHANGER TUBES HAVING INTERNAL STIFFENING STRUCTURE

[75] Inventors: Walter Mohn, North Canton; Douglas D. Zeigler, Atwater, both of Ohio

[73] Assignee: Hudson Products Corporation, Houston, Tex.

[21] Appl. No.: 353,939

[22] Filed: Dec. 12, 1994

[51] Int. Cl.[6] ..... F28F 1/02

[52] U.S. Cl. ..... 165/177; 165/906; 165/DIG. 537

[58] Field of Search ..... 165/109.1, 177, 165/906; 138/172, 114

[56] References Cited

U.S. PATENT DOCUMENTS

| | | | |
|---|---|---|---|
| 2,396,522 | 4/1946 | Modine | 138/47 |
| 3,486,489 | 12/1969 | Huggins | 165/177 X |
| 3,572,999 | 3/1971 | Sato | 165/177 X |
| 3,776,018 | 12/1973 | French | 72/367 |
| 4,360,958 | 11/1982 | Kritzer | 29/157.3 R |
| 4,676,953 | 8/1988 | Grieb et al. | 165/177 |
| 4,945,981 | 8/1990 | Joshi | 165/109.1 |
| 5,186,250 | 2/1993 | Ouchi et al. | 165/177 |
| 5,186,251 | 2/1993 | Joshi | 165/177 |
| 5,203,403 | 4/1993 | Yokoyama et al. | 165/151 |
| 5,251,692 | 10/1993 | Haussmann | 165/152 |
| 5,279,360 | 1/1994 | Hughes et al. | 165/111 |
| 5,318,114 | 6/1994 | Sasaki | 165/176 |

FOREIGN PATENT DOCUMENTS

| | | | |
|---|---|---|---|
| 61-211693 | 9/1986 | Japan | 165/906 |

*Primary Examiner*—Allen J. Flanigan
*Attorney, Agent, or Firm*—Robert J. Edwards; Eric Marich

[57] ABSTRACT

An elongated heat exchanger tube has an internally located stiffener assembly which prevents the deflection of the tube wall due to pressure differentials between the tube internal and external surfaces while allowing the flow of fluid between the areas on opposite sides of the stiffener inside of the tube. The heat exchanger tube can have an elliptical, oval or flat cross-section. The internal stiffener can have a variety of cross-sectional configurations having uniform or non-uniform shapes.

39 Claims, 3 Drawing Sheets

ELONGATED HEAT EXCHANGER TUBES HAVING INTERNAL STIFFENING STRUCTURE

FIELD AND BACKGROUND OF THE INVENTION

The present invention relates, in general, to heat exchanger tubes and, more particularly, to elongated elliptical, oval or flat heat exchanger tubes and their construction.

Some conventional heat exchangers typically comprise tubes having circular cross-sections and integrally bonded cooling fins. More recently, new heat exchanger designs have been developed using elliptical or flat heat exchanger tubes. These tubes are shaped similar to an airfoil and have surface bonded, peripheral cooling fins oriented in-line with the direction of air flow. Because these advanced heat exchanger tubes have configurations consisting of thin-walled elliptical cross-sections with major to minor axis ratios sometimes greater than 10, excessive deflections/deformations of the flat side walls due to external differential pressures of up to 15 psi have been observed, particularly in the central region. Such large deflections can cause cyclic fatigue, resulting in bond failure at the tube/cooling fin interface. An economical method of reducing or eliminating the flat tube wall deflection has thus been found necessary to enable the commercial manufacture of these advanced heat exchanger systems.

There are numerous granted U.S. patents drawn to designs of the aforementioned elliptical tube heat exchangers. However, none of them provide any type of internal stiffening to prevent the mentioned deflection problems. Any type of internal structure found in these patents which could be construed as adding stiffness to the elliptical heat exchanger tube is formed to produce separate internal passages within the elliptical heat exchange tube. These separate internal passages provided in the heat exchanger tubes are maintained separate and are not fluidically inter-connected, at least along the length of the tube.

Among these discussed prior art references are found the following U.S. patents which add structure which subdivides the elliptical tubes into chambers approximating circular tubes more than elliptical tubes with a major to minor axis ratio in excess of 10.

Haussmann (U.S. Pat. No. 5,251,692) discloses a flat tube heat exchanger having headers and a number of flat tubes between the headers. The flat tubes have flat sides and rounded short sides, as well as internal reinforcing ribs. The reinforcing ribs are spaced apart from one another by a distance ranging from about one to about two times the distance D between the outer surfaces of the flat tube 12.

Hughes et al. (U.S. Pat. No. 5,279,360) discloses an evaporator having tubes with a major and minor axis and containing therein a plurality of flow passages of generally triangular configuration. The flow passages are separated by integral webs extending between the sides of the tube. The webs serve to define individual and discrete flow paths, and strengthen the tubes against buckling of one side wall toward or away from the other when a bending force is applied across the tube major dimension.

Sasaki (U.S. Pat. No. 5,318,114) is drawn to a multi-layered type heat exchanger which includes a plurality of substantially parallel flat tubes. Each flat tube includes a partition wall dividing its interior into two fluid passages.

Grieb et al. (U.S. Pat. No. 4,766,953) is drawn to a shaped tube with an elliptical cross-section and a multi-chambered design for tubular heat exchangers. At least two cross rows pass through an interior space of the tube at a distance from one another. The tube is made by bending an endless metal strip into two semi-finished products with congruent profiles, each having the shape of an isosceles triangle with rounded vertices and an elongated leg. The semi-finished products are placed against one another so that the free end of the elongated leg of one semi-finished product abuts the triangle base edge of the other semi-finished product.

Kritzer (U.S. Pat. No. 4,360,958) is drawn to a method of making multi-port heat exchangers when the tubular members are made of a metal that does not lend itself well to being extruded into a plurality of passageways. Multiple passageways are provided in the tube however, by dividers inserted and adhered thereinto.

Modine (U.S. Pat. No. 2,396,522) is drawn to a radiator tube construction wherein upper and lower flat sheets are separated from one another and divided into a plurality of compartments by various members, some of which are circular while others have square cross-sections. These interspersed members are referred at various locations as being wire or the like.

Yokoyama et al. (U.S. Pat. No. 5,203,403) is drawn to a plate fin heat exchanger, and particularly to the cylindrical fin collars themselves. Side ridge portions promote increased turbulence and heat transfer efficiency.

U.S. Pat. Nos. 5,186,250 and 5,186,251 to Ouchi et al, and Joshi, respectively, disclose tubes for heat exchangers and methods for manufacturing same. In the '250 patent the tube is a flat tube comprising a pair of plane walls separated a distance from one another by U-shaped bent portions of the walls themselves. Alternatively, the U-shaped portions can comprise dimples 16. The '251 patent shows a heat exchanger with double row tubes made by a roll forming operation from a single piece blank that has a centralized vertical connector web of the thickness of the blank that connects and supports opposite side walls of the tube to augment tube burst strength for high internal pressures. The vertical connector web also effectively eliminates tube crushing from compression loads when inserted onto a core of tubes.

Thus it is seen that an effective stiffener for elliptical, oval or flat heat exchanger tubes having a ratio of major to minor axis of 10 or larger was needed which would allow the flow of fluid across the tube stiffeners.

SUMMARY OF THE INVENTION

The present invention solves the problems associated with prior art elliptical, oval or flat heat exchanger tubes as well as others by providing an internally formed, square cross-section tube in the middle of the heat exchanger tube. This construction is referred to as the $T^2$ construction to facilitate internal attachment (of the stiffener) to the main heat exchanger tube. The cross-section of the $T^2$ stiffener could be one of many uniform or non-uniform shapes attached by mechanical means, by adhesives, or by metallurgical bonding methods.

The $T^2$ stiffener has holes in the non-contacting (lateral) sidewalls to allow free passage of steam, water vapor, and gasses between the separate internal chambers created by its installation. While the $T^2$ stiffener effectively eliminates the deflection of the advanced elliptical, oval or flat heat exchanger tube sidewalls, it also creates a stronger, more rigid structural tube assembly in the same fashion that longitudinal stringers strengthen and stiffen an aircraft wing.

In view of the foregoing it will be seen that one aspect of the present invention is to provide a stiffener for an elliptical, oval or flat heat exchanger tube which will prevent wall deflection of such elliptical, oval or flat tubes having a major to minor axis of 10 or greater.

Another aspect of the present invention is to provide an internal stiffener for an elliptical, oval or flat heat exchanger tube which will allow the flow of fluid throughout the tube, and particularly inbetween chambers created in the heat exchanger tube when the internal stiffener is employed.

The various features of novelty which characterize the invention are pointed out with particularity in the claims annexed to and forming a part of this disclosure. For a better understanding of the present invention and the advantages attained by its use, reference is made to the accompanying drawings and descriptive matter in which a preferred embodiment of the invention is disclosed.

DESCRIPTION OF THE PREFERRED EMBODIMENT

Figure 1:
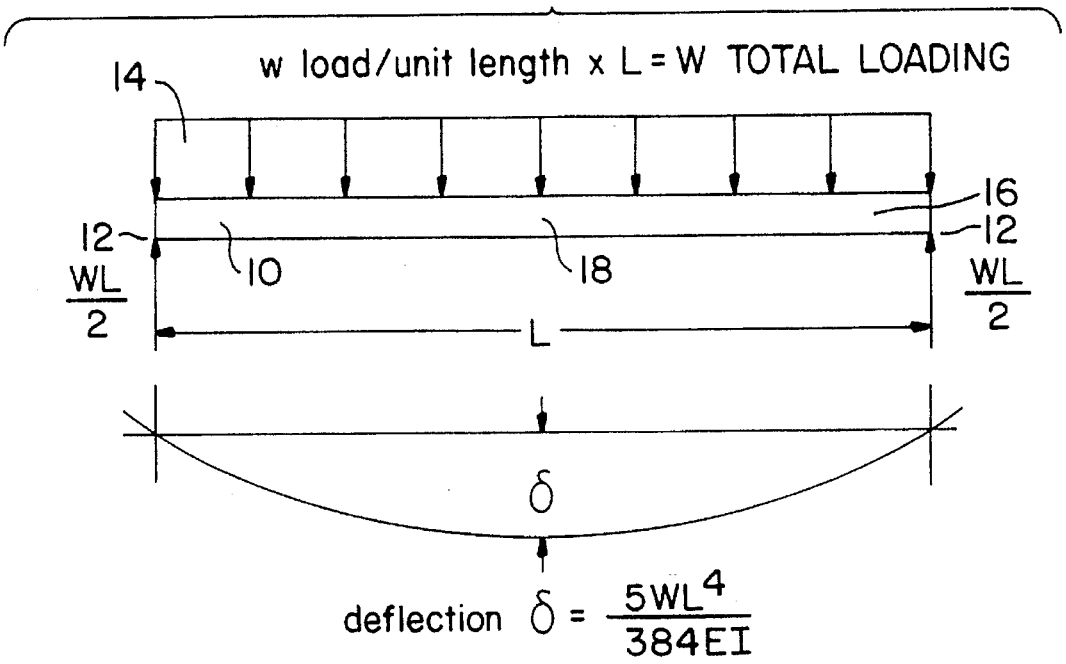
FIG. 1 is a depiction of a beam deflecting under an equally applied load along one surface thereof.

Turning now to the drawings generally, wherein like numerals designate the same or functionally similar elements throughout the several drawings, and to FIG. 1 in particular, the influence of elastic deformation on curved or flat tube walls, such as those forming elliptical, oval or flat heat exchanger tubes, will be more readily understood upon a consideration of the deflection of a uniformly loaded beam 10.

The beam 10 is of a length L and is supported at ends 12 and evenly loaded by load 14 producing a weight of w/unit length on the top surface 16 of the beam. The maximum deflection δ will occur at the midpoint 18 of the beam 10 as shown. This deflection δ is determined from known beam deflection analysis techniques to be defined by the following formula:

$$\delta=\frac{5\,WL^4}{384EI}$$

δ = beam deflection
$W$ = uniform total weight on the beam

-continued $L$ = length of the beam
$E$ = Young's Modulus of the beam
$I$ = Moment of Inertia of the beam Thus it is seen that a doubling of the length L of the beam will multiply the mid point deflection by a factor of sixteen.

The elliptical, oval or flat heat exchanger tubes may be analyzed according to the above analysis where the curved or flat tube wall is considered as the deflecting beam. The most significant way to reduce deflection is thus seen to lie in reducing the element beam length. This can be easily accomplished for the curved or flat walls of the heat exchanger tubes by installing, during manufacture, an internal support which effectively reduces the element length L by half. This stiffener can be a tube or rod formed during manufacture and placed within the elliptical, oval or flat heat exchanger tube. By virtue of the tube-within-a-tube ($T^2$) stiffener, side wall deflection at the center may be effectively reduced to zero, and the maximum deflection at the centers of the half-length beam elements is only one sixteenth of the original central deflection.

Figure 2:
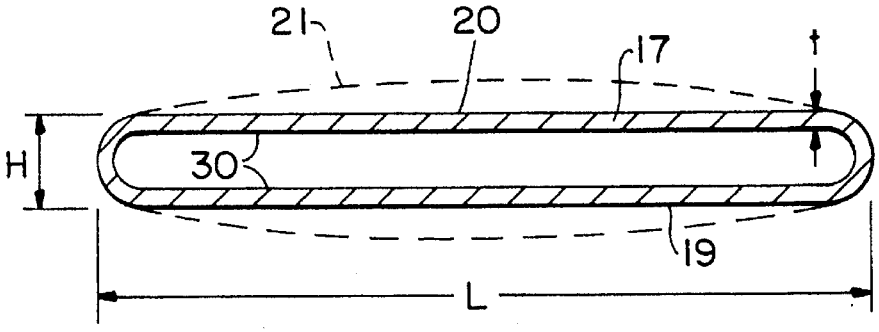
FIG. 2 is a cross-sectional end view of an elliptical, oval or flat heat exchanger tube having a major to minor axis ratio of 10 or greater.
Figure 3:
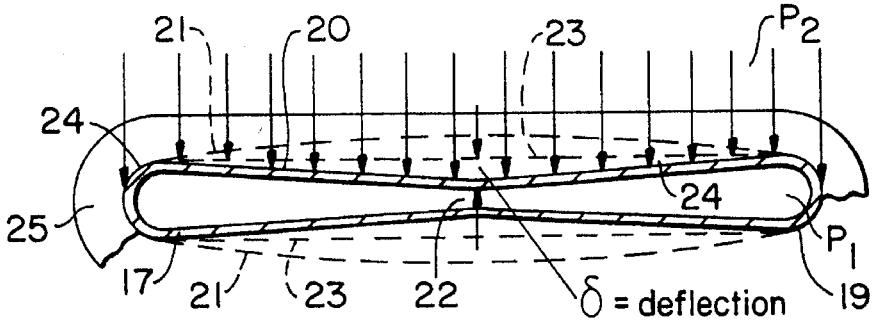
FIG. 3 is another cross-sectional end view depiction of the tube of FIG. 2, showing the deflection of the tube of FIG. 2 when subjected to a differential pressure $\Delta P=P_2-P_1$, along one side of the major axis of the tube.
Figure 4:
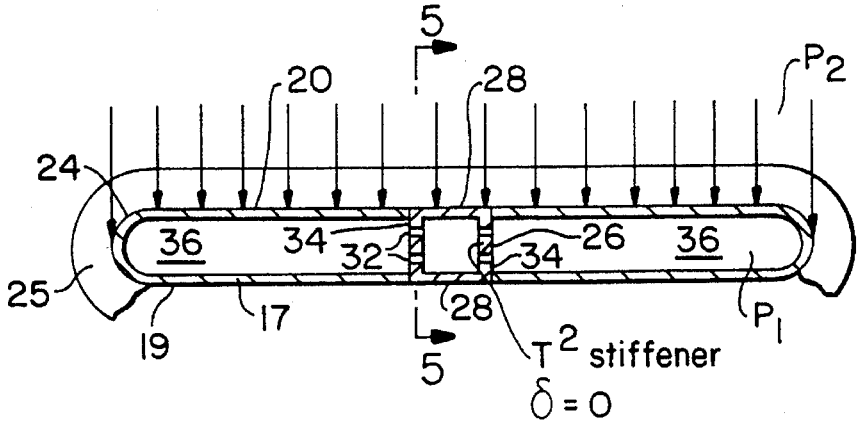
FIG. 4 is another cross-sectional end view depiction of the tube of FIG. 3 having one cross-sectional configuration of an internal $T^2$ stiffener according to the invention internally mounted therein.

In FIGS. 2 and 3, as well as in FIG. 4, discussed infra, the tube 20 would have a length extending perpendicular to the plane of FIGS. 2, 3 and 4. Thus the views of FIGS. 2–4 are cross-sectional views of tube 20, taken perpendicular to the longitudinal length or axis of the tube 20. In FIGS. 2 and 3 it is seen that a sidewall 17 of an elliptical, oval or flat heat exchanger tube 20, having a sidewall thickness t and normally having a length L to height H ratio of 10 or greater is significantly deflected inwardly a distance δ at a midpoint 22 by a pressure differential $\Delta P=P_2-P_1$ when an outside surface 19 of the sidewall 17 of the tube 20 is exposed to the greater pressure $P_2$, and the pressure within the tube 20 on the opposite side of sidewall 19 is exposed to a lesser pressure $P_1$. These large deflections cause cyclic fatigue, resulting in bond failure at an interface 24 between the sidewall 17 of tube 20 and attached fin 25. The original elliptical tube 20 profile is schematically represented as dashed line 21 in FIGS. 2 and 3, while the original oval or flat tube profile is schematically represented as dashed line 23 in FIG. 3.

The material and thickness of the heat exchanger tube 20 will be determined by the operating conditions. Typically, heat exchanger tubes 20 are carbon steel and 0.060" to 0.080" thick.

Figure 5:
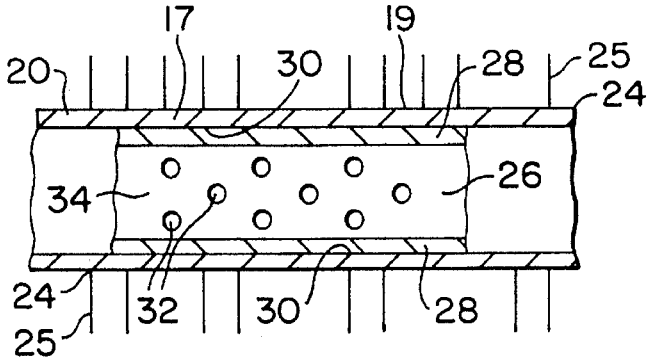
FIG. 5 is a sectional view of the internal $T^2$ stiffener of the invention taken in the direction of arrows 5—5 of FIG. 4, some of the fins on the heat exchanger tube being omitted for clarity.

Turning now to FIG. 4 it is seen that this deflection δ in the tube 20 is eliminated without impairing the operation of the tube 20 by installing, during manufacture, an internal stiffener tube 26 having a square, rectangular, circular or other cross-section which effectively reduces the beam element length of the tube 20 by one-half. The stiffener tube 26 is attached to the sidewall 17 of heat exchanger tube 20 at its mid point 22 by mechanical, adhesive, or metallurgical means adhering faces 28 of the stiffener tube 26 to an internal surface 30 of the tube 20. The material and thickness of the stiffener tube 26 would typically be the same as that of heat exchanger tube 20. Sidewall deflection at the center of the tube wall is thus effectively reduced to zero, and the maximum deflection at the center of the half-length beam or sidewall 17 elements is thus only 1/16 of the original central defection. As shown in FIGS. 4 and 5, the internal stiffener tube 26 will have apertures or holes 32 in its non-contacting (lateral) side walls 34 to allow free passage of steam, water vapor, and/or gases between the separate internal chambers or areas 36 created by the installation of the stiffener tube 26.

Figure 6:
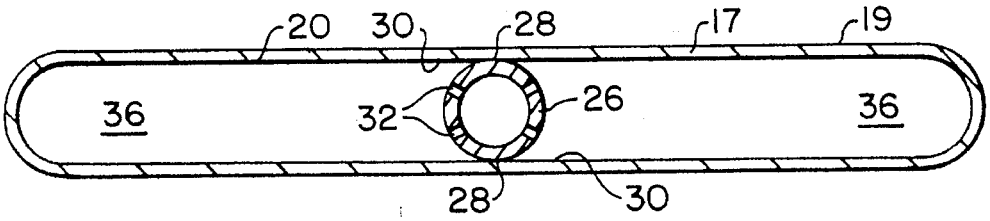
FIGS. 6–11 are cross-sectional end views of other embodiments of the $T^2$ stiffener structure according to the invention mounted internally of a heat exchanger tube.
Figure 7:
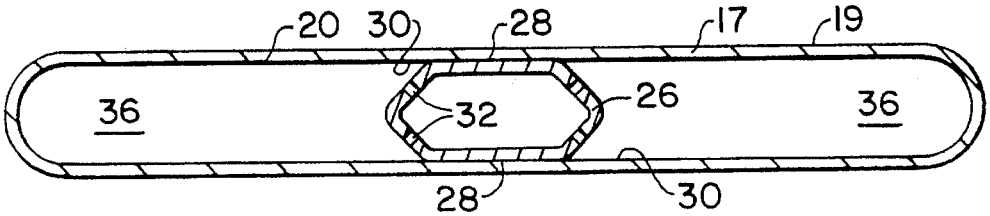
Figure 8:
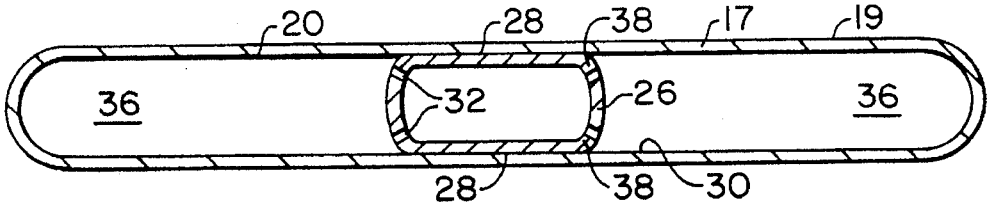
Figure 9:
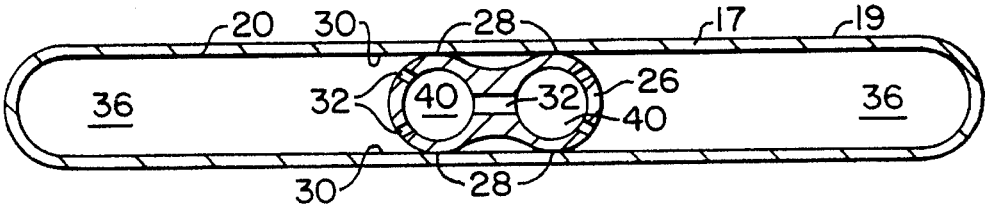
Figure 10:
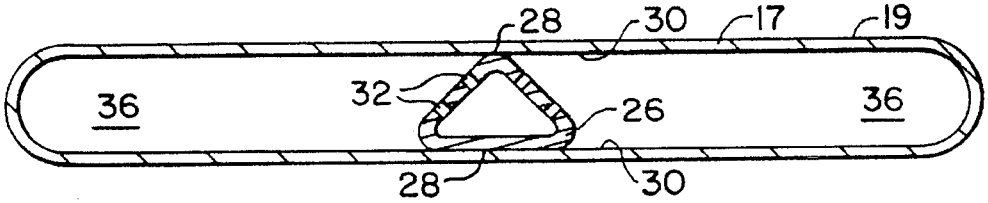
Figure 11:
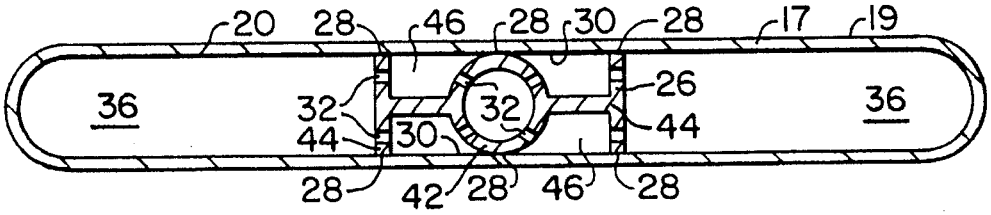

As indicated earlier, the cross-section of the $T^2$ stiffener can be one of many uniform or non-uniform shapes and attached by mechanical means, by adhesives, or by metallurgical bonding methods. FIGS. 6–11 disclose examples of several cross-sectional configurations of the $T^2$ stiffener tube 26 located within a heat exchanger tube 20. For the sake of conciseness, the tube 20 shown has a flat configuration but it will appreciated that oval or elliptical tubes 20 could also be provided with the various internal stiffening structures shown. FIG. 6 shows an internal stiffening tube 26 having the aforementioned circular cross-section, provided with apertures or holes 32. FIG. 7 shows a hexagonal shaped internal stiffener tube 26; FIG. 8 shows an oblong or substantially rectangular internal stiffener tube 26 having rounded corners 38; FIG. 9 shows a figure-eight shaped internal stiffening tube 26 which has two internal passageways 40 along the length thereof fluidically interconnected therebetween and with chambers 36 by apertures 32; FIG. 10 shows a triangular shaped internal stiffener tube 26; and FIG. 11 shows a combination internal stiffener tube 26 having a substantially circular central portion and two laterally extending T-shaped side flanges 44 connected thereto. As with the earlier embodiments described above, suitable apertures or holes 32 would be provided to fluidically connect separate internal chambers 46 with chambers 36 created by installation of the internal stiffener tube 26 within the heat exchanger tube 20.

This $T^2$ assembly thus provides a more cost effective and lightweight elliptical, oval or flat heat exchanger tube having thinner walls for better heat transfer since the supports do not impair its operation while eliminating harmful deflections normally associated with the thinner walls.

While specific embodiments of the invention have been shown and described in detail to illustrate the application of the principles of the invention, those skilled in the art will appreciate that changes may be made in the form of the invention covered by the following claims without departing from such principles. In some embodiments of the invention, certain features of the invention may sometimes be used to advantage without a corresponding use of the other features. Accordingly, all such changes and embodiments properly fall within the scope of the following claims.

We claim:

1. An elliptically shaped heat exchanger tube which provides increased resistance to sidewall deflection caused by a differential pressure existing when an outside surface of the tube sidewall is subjected to a first pressure, and an inside surface of the tube sidewall is subjected to a second different pressure, comprising:

a tube-shaped assembly, located within the heat exchanger tube, for preventing deflection of the tube surfaces due to pressure differential without interfering with a flow of fluid between separate internal chambers of the heat exchanger tube which are created when the tube-shaped assembly is located within the heat exchanger tube; and means for securing the deflection preventing means to the inside surface of the heat exchanger tube.

2. The tube as set forth in claim 1, wherein said tube shaped assembly is mounted internally in the heat exchanger tube to run the length of said tube and has apertures therein to allow the fluid in said tube to flow through said tube shaped assembly between the separate chambers.

3. The tube as set forth in claim 2, wherein said heat exchanger tube has a cross-sectional width to height ratio of 10 or greater.

4. The tube as set forth in claim 2, wherein said tube shaped assembly is mounted along the midpoint of a longitudinal length of said heat exchanger tube.

5. The tube as set forth in claim 4, wherein said tube shaped assembly is substantially rectangular in cross-section.

6. The tube as set forth in claim 2, wherein said tube shaped assembly has a rectangular cross-section and a first set of opposite faces affixed to opposite internal walls of said heat exchanger tube and a second set of opposite faces having apertures therein to allow fluid flow therethrough between the chambers on opposite sides of the rectangular tube shaped assembly.

7. The tube as set forth in claim 2, wherein said tube shaped assembly is substantially circular in cross-section.

8. The tube as set forth in claim 2, wherein said tube shaped assembly is substantially hexagonal in cross-section.

9. The tube as set forth in claim 2, wherein said tube shaped assembly is substantially rectangular with rounded corners in cross-section.

10. The tube as set forth in claim 2, wherein said tube shaped assembly is substantially figure-eight in cross-section.

11. The tube as set forth in claim 2, wherein said tube shaped assembly is substantially triangular in cross-section.

12. The tube as set forth in claim 2, wherein said tube shaped assembly is substantially a composite shape comprised of a circular central portion and two laterally extending T-shaped side flanges.

13. The tube as set forth in claim 1, wherein the heat exchanger tube is provided with a plurality of fins on said outside surface.

14. An oval shaped heat exchanger tube which provides increased resistance to sidewall deflection caused by a differential pressure existing when an outside surface of the tube sidewall is subjected to a first pressure, and an inside surface of the tube sidewall is subjected to a second different pressure, comprising:

a tube-shaped assembly, located within the heat exchanger tube, for preventing deflection of the tube surfaces due to the pressure differential without interfering with a flow of fluid between separate internal chambers of the heat exchanger tube which are created when the tube-shaped assembly is located within the heat exchanger tube; and means for securing the deflection preventing means to the inside surface of the heat exchanger tube.

15. The tube as set forth in claim 14, wherein said tube shaped assembly is mounted internally in the heat exchanger tube to run the length of said tube and has apertures therein to allow the fluid in said tube to flow through said tube shaped assembly between the separate chambers.

16. The tube as set forth in claim 15, wherein said heat exchanger tube has a cross-sectional width to height ratio of 10 or greater.

17. The tube as set forth in claim 15, wherein said tube shaped assembly is mounted along a midpoint of a longitudinal length of said heat exchanger tube.

18. The tube as set forth in claim 17, wherein said tube shaped assembly is substantially rectangular in cross-section.

19. The tube as set forth in claim 15, wherein said tube shaped assembly has a rectangular cross-section and a first set of opposite faces affixed to opposite internal walls of said heat exchanger tube and a second set of opposite faces having apertures therein to allow fluid flow therethrough between the chambers on opposite sides of the rectangular tube shaped assembly.

20. The tube as set forth in claim 15, wherein said tube shaped assembly is substantially circular in cross-section.

21. The tube as set forth in claim 15, wherein said tube shaped assembly is substantially hexagonal in cross-section.

22. The tube as set forth in claim 15, wherein said tube shaped assembly is substantially rectangular with rounded corners in cross-section.

23. The tube as set forth in claim 15, wherein said tube shaped assembly is substantially figure-eight in cross-section.

24. The tube as set forth in claim 15, wherein said tube shaped assembly is substantially triangular in cross-section.

25. The tube as set forth in claim 15, wherein said tube shaped assembly is substantially a composite shape comprised of a circular central portion and two laterally extending T-shaped side flanges.

26. The tube as set forth in claim 8, wherein the heat exchanger tube is provided with a plurality of fins on said outside surface.

27. A flat shaped heat exchanger tube which provides increased resistance to sidewall deflection caused by a differential pressure when an outside surface of the tube sidewall is subjected to a first pressure, and an inside surface of the tube sidewall is subjected to a second different pressure, comprising:

a tube-shaped assembly, located within the heat exchanger tube, for preventing deflection of the tube surfaces due to the pressure differential without interfering with a flow of fluid between separate internal chambers of the heat exchanger tube which are created when the tube-shaped assembly is located within the heat exchanger tube; and means for securing the deflection preventing means to the inside surface of the heat exchanger tube.

28. The tube as set forth in claim 27, wherein said tube shaped assembly is mounted internally in the heat exchanger tube to run the length of said tube and has apertures therein to allow the fluid in said tube to flow through said tube shaped assembly between the separate chambers.

29. The tube as set forth in claim 28, wherein said heat exchanger tube has a cross-sectional width to height ratio of 10 or greater.

30. The tube as set forth in claim 28, wherein said tube shaped assembly is mounted along a midpoint of a longitudinal length of said heat exchanger tube.

31. The tube as set forth in claim 30, wherein said tube shaped assembly is substantially rectangular in cross-section.

32. The tube as set forth in claim 28, wherein said tube shaped assembly has a rectangular cross-section and a first set of opposite faces affixed to opposite internal walls of said heat exchanger tube and a second set of opposite faces having apertures therein to allow fluid flow therethrough between the chambers on opposite sides of the rectangular tube shaped assembly.

33. The tube as set forth in claim 28, wherein said tube shaped assembly is substantially circular in cross-section.

34. The tube as set forth in claim 28, wherein said tube shaped assembly is substantially hexagonal in cross-section.

35. The tube as set forth in claim 28, wherein said tube shaped assembly is substantially rectangular with rounded corners in cross-section.

36. The tube as set forth in claim 28, wherein said tube shaped assembly is substantially figure-eight in cross-section.

37. The tube as set forth in claim 28, wherein said tube shaped assembly is substantially triangular in cross-section.

38. The tube as set forth in claim 28, wherein said tube shaped assembly is substantially a composite shape comprised of a circular central portion and two laterally extending T-shaped side flanges.

39. The tube as set forth in claim 14, wherein the heat exchanger tube is provided with a plurality of fins on said outside surface.

* * * * *